US006397739B1

(12) United States Patent
Viljanmaa

(10) Patent No.: US 6,397,739 B1
(45) Date of Patent: Jun. 4, 2002

(54) CALENDERING METHOD AND A CALENDER THAT MAKES USE OF THE METHOD

(75) Inventor: Mika Viljanmaa, Helsinki (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/402,210

(22) PCT Filed: Mar. 26, 1998

(86) PCT No.: PCT/FI98/00270

§ 371 (c)(1),
(2), (4) Date: Sep. 30, 1999

(87) PCT Pub. No.: WO98/44196

PCT Pub. Date: Oct. 8, 1998

(30) Foreign Application Priority Data

Apr. 2, 1997 (FI) ..... 971343

(51) Int. Cl.[7] ..... D21G 1/02; B30B 3/04

(52) U.S. Cl. ..... 100/38; 100/74; 100/310; 100/314; 100/331; 100/153; 100/162 R

(58) Field of Search ..... 100/38, 74, 309, 100/310, 313, 314, 331, 153, 161, 162 R, 163 R, 162 B, 173; 162/206, 207, 358.3, 358.4, 358.5, 360.2, 360.3

(56) References Cited

U.S. PATENT DOCUMENTS 4,596,633 A 6/1986 Attwood
4,697,511 A * 10/1987 Davis et al. ..... 100/153 X
5,131,324 A * 7/1992 Lassila et al. ..... 100/153
5,163,364 A 11/1992 Bubik et al.
5,524,532 A * 6/1996 Koivukunnas et al. ..... 100/161

FOREIGN PATENT DOCUMENTS

| | | | |
|---|---|---|---|
| DE | 4344165 | 6/1995 | |
| EP | 0018954 | 11/1980 | |
| EP | 0337973 | 10/1989 | |
| EP | 0617165 | 9/1994 | |
| FR | 2588293 A1 * | 4/1987 | ..... D21G/1/02 |
| JP | 54-46264 A * | 4/1979 | ..... D21G/1/00 |
| WO | WO-94/28239 A1 * | 12/1994 | ..... D21G/1/00 |
| WO | 95/34714 | 12/1995 | |

* cited by examiner

*Primary Examiner*—Stephen F. Gerrity
(74) *Attorney, Agent, or Firm*—Steinberg & Raskin, P.C.

(57) ABSTRACT

A calendering method and calender in which a web material is passed through a calender, the calender nip being defined between a heatable hard roll and an endless, flexible and substantially non-compressible calendering belt. The heatable roll is heated in order to plasticize the surface layer of the web and the web is brought into contact with the heatable roll before the calendering of the web. After the preliminary contact of the web with the heatable roll a press treatment proper is applied to the web to be calendered in two stages. First a deformation is produced in the web in a press stage, after that the deformation that was produced is allowed to be reversed partially in a reversing stage and then a new deformation is produced in the web by pressing the web again in a finishing stage.

22 Claims, 3 Drawing Sheets

PRIOR ART

PRIOR ART

CALENDERING METHOD AND A CALENDER THAT MAKES USE OF THE METHOD

CROSS REFERENCE TO RELATED APPLICATIONS

Figure 1A:
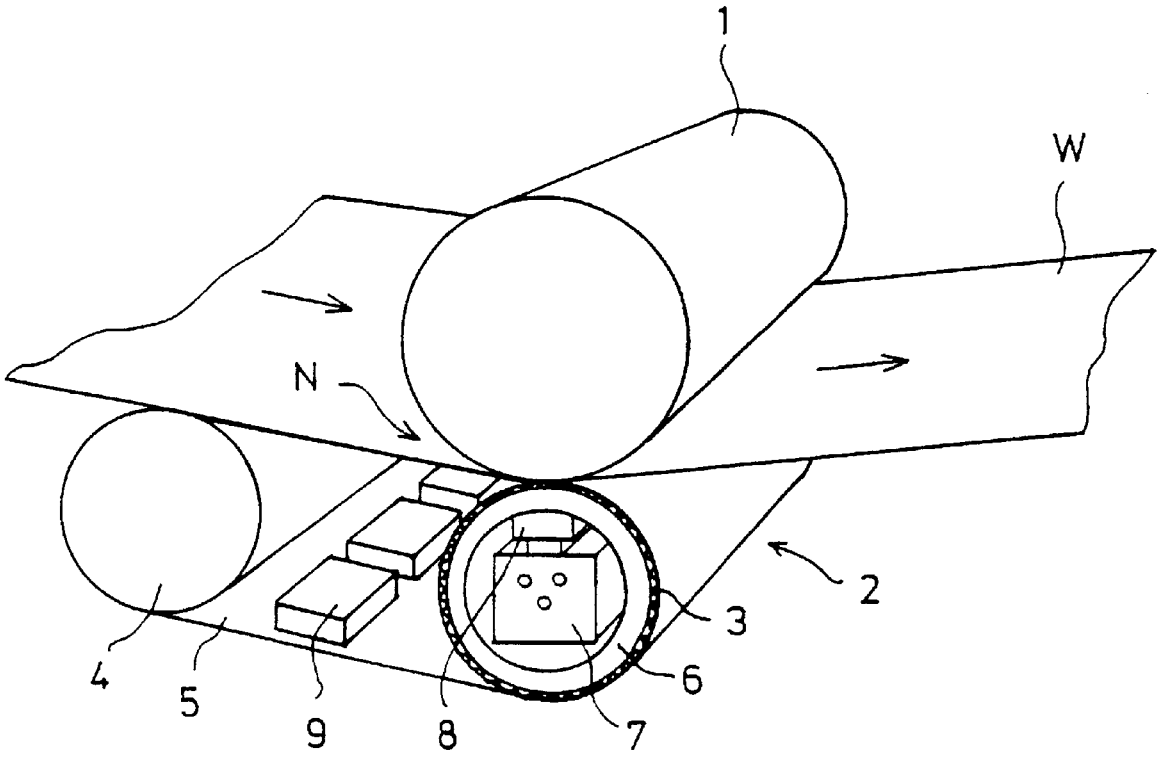

This is the national phase under 35 USC 371 of PCT international application no. PCT/FI98/00270 which has an international filing date of Mar. 26, 1998, which designated the United States of America.

FIELD OF THE INVENTION

The invention concerns a calendering method, in which the material web to be calendered, in particular a paper or board web, is passed through the calender, in which calender the calendering nip is formed between a heatable hard roll and an endless, flexible and substantially non-compressible calendering belt passed over said roll, in which connection, in the method, the heatable hard roll is heated in order to plasticize the surface layer of the material web to be calendered placed at the side of the heatable roll, and in which connection the material web to be calendered is brought into a preliminary contact with the heatable roll before the calendering proper of the web, i.e. before the stage in which the material web is pressed between the heatable hard roll and the calendering belt.

Also, the invention concerns a calender that makes use of the calendering method, comprising a calendering nip which is formed between a heatable hard roll and an endless, flexible and substantially non-compressible calendering belt passed over said roll, through which calendering nip the material web to be calendered, in particular a paper or board web, has been fitted to pass, in which connection the heatable hard roll has been arranged to be heated in order to plasticize the surface layer of the material web to be calendered that is placed at the side of the heatable roll, and in which connection the material web to be calendered has been passed into a preliminary contact with the heatable roll before the calendering proper of the web, i.e. before the stage in which the material web has been arranged to be pressed between the heatable hard roll and the calendering belt.

BACKGROUND OF THE INVENTION

When it is desirable to improve the standard of calendering, with the present solutions, in actual fact, the only possibility is to increase the number of calendering nips. This results in a more complicated construction of the calender and in more difficult control and tail threading of the paper web. Especially in the case of on-line machines, it must be possible to solve the contradictions arising from high running speed and from threading at full speed, Attempts have been made to solve these problems by means of various belt and shoe calenders, by whose means the calendering nip is extended and, thus, the operation of the nip is made more efficient. For example, in belt calenders, which in themselves are relatively recent constructions, the paper to be calendered is passed by means of an endless belt into a preliminary contact with a hot calender roll, in which case it is possible to create a steep temperature gradient, which is favourable from the point of view of calendering. By means of the belt, the effective length of the nip is increased, owing to the preliminary contact and because, as the belt material, it is possible to use considerably softer polymers than in roll coatings without problems arising from deformations related to heat. With a nip longer than in a supercalender or soft calender, the press impulse applied to the paper can be increased so that the pressure peak does not become excessively high and that the bulk does not start decreasing.

One belt calender solution has been described in the prior art, for example, in the Finnish Patent No. 95,061. A calender embodiment in accordance with said publication is illustrated schematically in FIG. 1A in the drawing, which figure represents the prior art. Thus, FIG. 1A is a schematic illustration of a prior-art calender, in which the calendering nip N is formed between a heatable hard roll 1 and a calendering belt, in particular a metal belt 5, supported by a roll 2 with resilient coating. The metal belt 5 is an endless belt, and its material can be, for example, steel. The belt is passed over a nip roll 2 provided with a resilient coating 3 and over a reversing roll 4. As was already stated above, in this prior-art calender, the calendering nip N is, thus, formed between a heatable hard roll 1 and said metal belt 5, which is supported by a calender roll 2 provided with a resilient coating. Such a solution is, in fact, quite extensively similar to a nip in a soft calender, in which, however, by means of the metal belt 5, both faces of the paper W can be subjected to a substantially equal treatment and, thus, the glazing can be made to take place at both sides of the paper W at the same time.

Figure 1B:
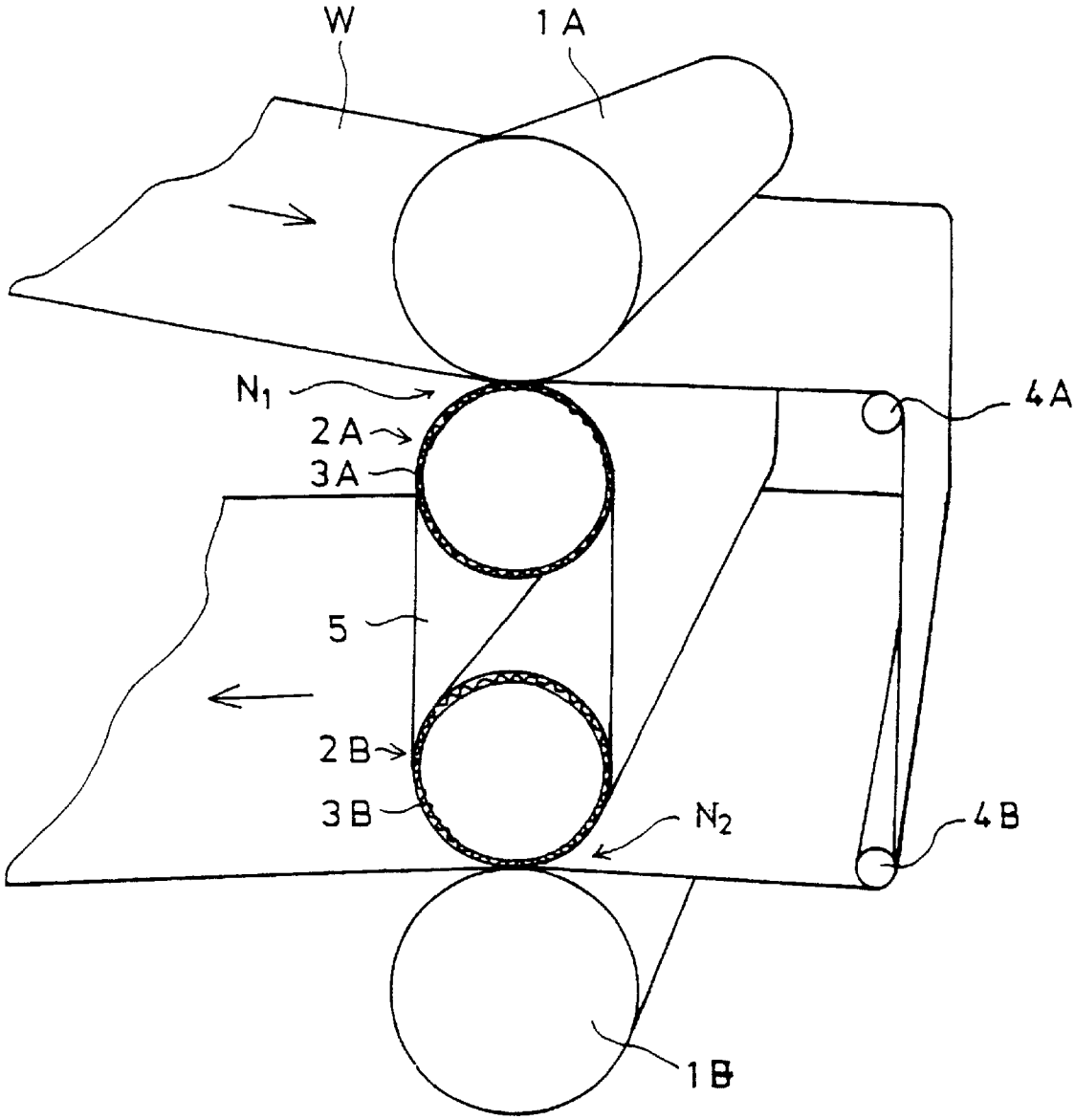

Further, FIG. 1B illustrates a further development of the prior-art calender as shown in FIG. 1A. In the illustration in FIG. 1B, the calender has been extended to be a calender with two nips, so that the calender comprises two heatable hard-faced calender rolls 1A and 1B, two calender rolls 2A,2B provided with resilient roll coatings 3A, 3B, and an endless metal belt 5. The endless metal belt 5 is passed over said rolls 2A,2B with resilient coatings, and said rolls with resilient coatings form calendering nips $N_2$,$N_2$ with the heatable hard-faced rolls 1A,1B. More correctly, the calendering nips are formed, in each particular case, between the heatable hard-faced roll 1A,1B and the metal belt 5, which metal belt 5 is loaded by means of a corresponding roll 2A,2B with a resilient coating against the heatable hard-faced roll 1A,1B. As is shown in FIG. 1B, the paper web W is passed through the first nip $N_1$, after which the web is spread and reversed by means of the take-out leading rolls 4A,4B and guided into the second nip $N_2$. The construction and the operation of the rolls 2A,2B with resilient coatings are similar to the illustration in FIG. 1A. The prior-art calenders as shown in FIGS. 1A and 1B are suitable for use with paper grades that do not require a long nip time to be glazed. Such paper grades are, for example, coated grades in which the glass transition temperature of the coating paste is low and in which, therefore, the glazing is rapid.

In view of on-line operation, a belt calender provides a significant advantage, among other things, in respect of the clear and linear running of the paper web, which again permits tail threading taking place at a high speed. In a belt calender supported by means of a glide shoe, the nip is formed between an endless belt and a steel roll. Owing to the glide shoe, the press zone becomes wider than in the belt calender described above. In a nip in a shoe calender, owing to the wider nip, the maximal pressure remains lower than in other present-day calenders, for which reason it is best suitable for paper grades in which retaining of the bulk has a high importance. As regards its construction, such a shoe calender is quite extensively similar to extended-nip presses, which have already been in use for a rather long time.

In respect of the prior art, as an example that represents shoe calendering, reference can be made, e.g., to the Published German Patent Application No. 43 44 165, wherein a smoothing method is described in which the fibrous web is passed in between two heatable faces which have been fitted at both sides of the web and which can be pressed against the web. The compression pressure can be regulated both in the running direction of the web and in the cross direction of the web in a way that has been chosen in advance. The prior art also includes the U.S. Pat. No. 5,163,364, which concerns a similar equipment provided with a glide shoe.

In respect of belt-supported calender concepts, reference is made additionally to the U.S. Pat. No. 4,596,633, in which a web finishing process is described, wherein the surface portions of the web to be finished are first moistened to a high degree of moisture (dry solids content 50% . . . 70%), and the web is then passed, on support of a belt, into a long finishing zone of low pressure, which zone comprises more than one roll nips. In said method, as the belt, prior-art paper machine fabrics are employed, such as felts, wires or polymer belts, while the surface treatment proper is applied exclusively to the side of the web placed facing the backup roll.

In surface treatment devices provided with a glide shoe, it can be considered that the, at least partly dragging, contact between the belt and the glide shoe is a problem, which contact applies quite a high strain both to the glide shoe and also to the belt. When a technology commonly employed in initial drying of a fibrous web has been applied, it has been realized that the quality of a belt that is well suitable for initial drying and that operates well in initial drying is inadequate in conditions of finishing of the web surface, in particular in respect of its resistance to the higher strains applied to the belt. Also, of course, the high local strains applied to the belt in web break situations are an almost equally important problem as in polymer-coated rolls, even though a similar polymer present in belt form tolerates considerably higher strains than a coating attached to a roll face rigidly does. In shoe calenders with solutions provided with a glide shoe and a belt, it is a further problem that the ends of the belt must always be closed, or spreading into the environment of the fluid and/or evaporation product employed in order to reduce the glide friction must be prevented in some other way.

A long belt circulation and a roll nip involve a similar basic problem. The quality of the belt face and a homogeneous inner structure are an unconditional requirement in order that a uniform quality of web surface could be achieved, and, moreover, keeping the long belt loops, which are made of a more or less elastic material and which often comprise more than on belt alignment roll, in their position in the cross direction of the web requires the construction of a regulation system of remarkable complexity in connection with the finishing device.

OBJECTS AND SUMMARY OF THE INVENTION

The present invention concerns a calendering method and in particular a calendering method that makes use of a metal belt calender, in which, by means of an endless metal belt, a calender with a very long nip is provided so that attempts are made to create all stages of the calendering process in one and the same calendering nip without unnecessary additional operations. The basic idea of the invention is to prevent contact between the web to be treated and soft roll coatings while, however, taking advantage of the effect of extending the calendering zone of said soft roll coatings. Thus, the object of the invention is to provide a calendering method that has been improved substantially, as compared with the prior art, and a calender that operates in accordance with this improved method, by means of which calender the calendering process can be made readily controllable and by means of which method the construction of the calender that carries out the method can be made relatively simple. In view of achieving the objectives of the invention, the method in accordance with the invention is mainly characterized in that, after the stage of preliminary contact, the press treatment proper is applied to the material web to be calendered, i.e. the web is calendered in at least two stages so that a deformation is produced in the material web so that it is first pressed in the press stage between the heatable hard roll and the calendering belt by means of a first roll provided with a resilient coating, the deformation that was produced in the press stage is allowed to be reversed partially under control in a reversing stage by still keeping the material web supported between the heatable hard roll and the calendering belt, and a new deformation is produced in the material web, which was already once pressed and partly reversed, by pressing the web again in a finishing press stage between the heatable hard roll and the calendering belt by means of a second roll provided with a resilient coating.

On the other hand, the calender in accordance with the invention is mainly characterized in that, in view of carrying out the press treatment proper, i.e. the calendering of the web, after the stage of preliminary contact, in the running direction of the calendering belt, at least two calender rolls provided with resilient coatings have been fitted one after the other at a distance from one another to press the calendering belt against the heatable hard roll so that the nip is composed of the press zone proper placed between the first calender roll with a resilient face and the heatable roll, of a zone of reversing of the deformation, following after said press zone, in which zone the material web to be calendered is supported between the calendering belt and the hot roll, and of a finishing press zone following after the reversing zone and placed between the second calender roll with a resilient face and the heatable roll.

By means of the invention, as compared with the prior-art calendering methods and calenders, a number of significant advantages are achieved, of which, for example, the following can be stated in this connection.

When, in the present invention, a flexible, thin and substantially non-compressible belt is used in a novel way together with rolls provided with compressible or non-compressible coatings, a very wide range of regulation of pressure is obtained together with a simultaneous range of high running speeds. Further, when a substantially non-compressible belt, whose material can be metal or, for example, a hard polymer, such as a fibre-reinforced resin, and a roll that is provided with a resilient coating and that supports said belt at the nip are employed, a resilient finishing zone is obtained which has a face of very high quality and which is adapted against the web face very well in compliance with the loading. Further, by means of the solution in accordance with the invention, a finishing device is provided in which the overall length of the web treatment zone is very long and, if necessary, includes a number of zones with different pressure ranges. An essential feature of a calender in accordance with the present invention is the hardness of the calendering belt that is used, as compared with the roll coating. This provides the highly significant advantage that tail threading is free of problems and easy, for the leader end of the web can be passed through the calender as of full width. The further advantages and characteristic features of the invention will come out from the following detailed description of the invention.

BRIEF DESCRIPTION OF THE INVENTION

In the following, the invention will be described by way of example with reference to the figures in the accompanying drawing.

As was already stated above, FIGS. 1A and 1B illustrate prior-art calenders so that FIG. 1A is a schematic illustration of a calendering nip which has been provided by means of a heatable hard roll and an endless metal belt that is supported by a roll provided with a resilient coating. On the other hand, FIG. 1B is a schematic illustration of a calender with two nips, in which the calendering nips are formed between hard rolls and a metal belt supported by rolls provided with resilient coatings.

Figure 2:
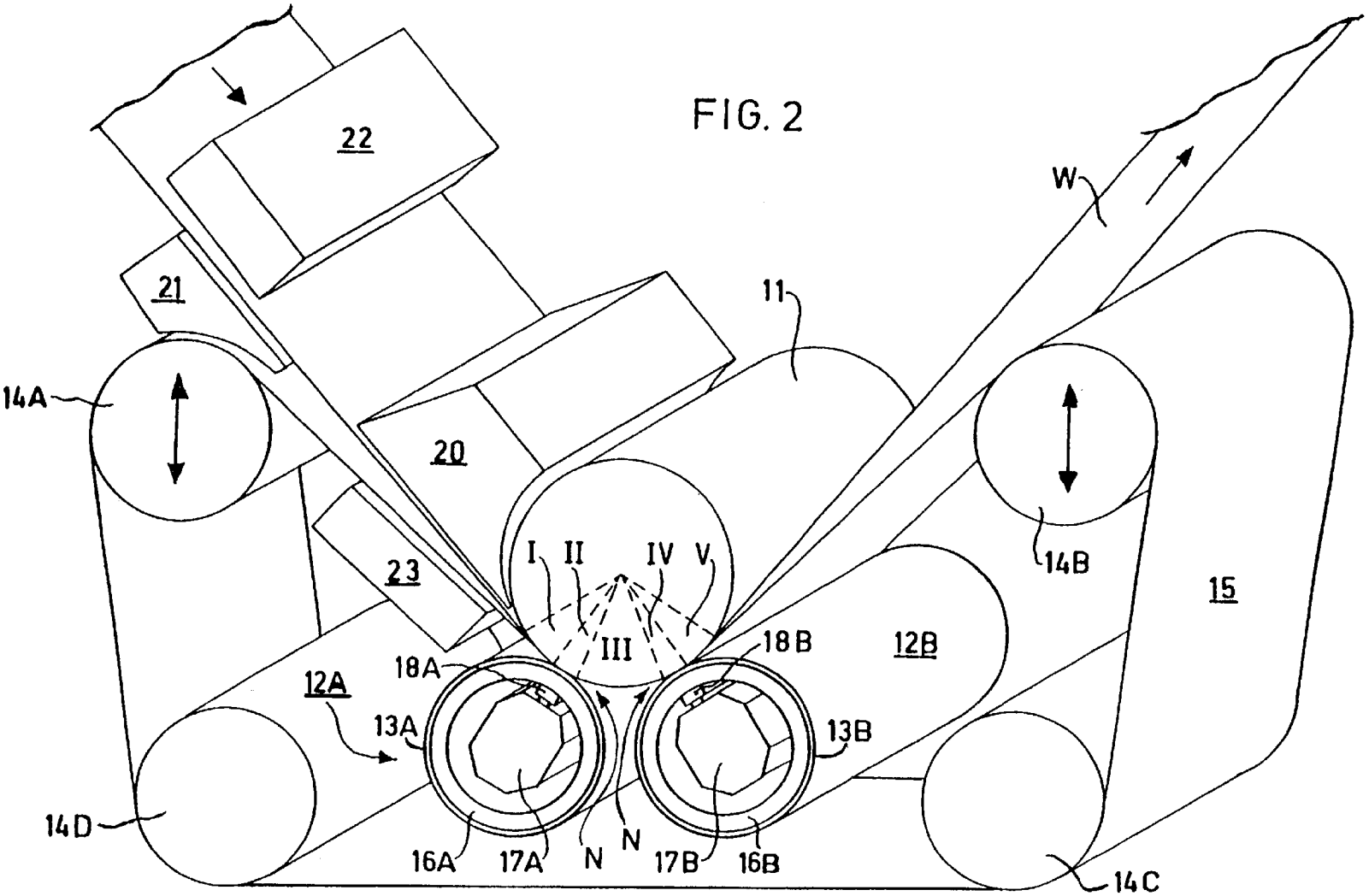

FIG. 2 is a schematic illustration of a calender which makes use of the calendering method in accordance with the invention and which permits a glazing process in five stages, in which process the relationship between and within the different stages can be regulated.

DETAILED DESCRIPTION OF THE INVENTION

Regarding a calendering process in general, it can be stated that, in order that a paper could be made smooth and glazed from both sides, in the calendering nip there must be a smooth face against each side of the paper. When an on-line calender is concerned, two opposite hard steel rolls form an excessively narrow nip in order that a deformation of the desired nature had time to arise in the paper at a high running speed. When one of the hard-faced calender rolls is substituted for by an endless calendering belt supported by a roll or by several rolls provided with a resilient coating, in particular by a metal belt, a considerably extended nip is obtained, in which both sides of the paper are subjected to an equal treatment. The necessary pressing in the calendering nip is produced mainly by means of the rolls that support the calendering belts and partly by regulating the tension of the calendering belt. Depending on the requirement, the calendering belt can be supported either by hard rolls or by rolls provided with resilient coatings. The effect of a calendering belt supported by hard steel rolls on the paper is similar to that in a machine calender, which means that variations in thickness of the paper are calibrated efficiently. However, since the nip time is considerably longer than in a machine calender, owing to the contact between the paper and the calendering belt and owing to the rigidity of the calendering belt, it can be assumed that the desired visco-elastic deformation has time to take place to a greater extent than in an ordinary machine calender.

A steel belt supported by means of rolls provided with resilient coatings and fitted against a steel roll subjects the paper, at the rolls, to a press impulse similar to that in a supercalender. Also, in the area between the rolls, the paper is subjected to a press impulse arising from the tension of the belts, the function of said impulse being mainly to prevent reversing of the deformations that arose at the rolls. When rolls with resilient coatings are employed, the risk of damaging of the roll coatings is considerably lower than in a supercalender or soft calender, for the rolls are not in direct contact with the paper to be glazed, but the calendering belt protects the coatings efficiently from marking in the event of possible web breaks. The use of a calendering belt in a nip between the paper and a roll with resilient coating permits efficient cooling of the roll with resilient coating, which contributes to permitting a high running speed.

Calendering can also be carried out as a so-called friction calendering, which is based, besides on the pressing of the paper placed between the faces, also on different speeds of the faces and the paper and on glide friction arising from said differences in speed. A normal copying arising from a press tension is intensified, besides owing to the rising of the temperature caused by the friction, also because the friction between the glazing face and the paper has been converted from static friction to kinetic friction, which is, as is well known, the lower one of these two. Even though, in the present-day solutions, gliding takes place in the machine direction only, the movement of the polymers is also facilitated in the cross direction because of the transition from the static friction to the kinetic friction. In the solutions employed so far, the friction has been produced by rotating the rolls that form the nip at a slight mutual difference in speed. The extent of gliding per unit of length has been very little, but an improvement of the final result can, however, have been noticed. Problems are mainly runnability and precise regulation of the speeds of rotation of the rolls. Friction calendering can also be employed in an extended-nip calender that makes use of a calendering belt. In such a calender, even with a very little difference in speed between the faces, the gliding to which the paper is subjected is considerably large because of the extended nip. In addition to the general principles of calendering described above, the invention will be illustrated in the following with reference to FIG. 2 in the drawing mentioned above with the aid of the particular alternative embodiments of the invention illustrated in said figure.

Thus, FIG. 2 illustrates a preferred embodiment of a calender in accordance with the invention, in which calender an extended calendering nip N has been formed between a heatable hard roll 11 and a calendering belt 15, in particular a metal belt, supported by means of two rolls 12A,12B provided with resilient coatings 13A,13B. Thus, the material web W to be calendered, in particular a paper web, board web, or equivalent, is passed through the nip, in which, at one side, there is the heatable hard roll 11, and at the opposite side the calendering belt 15, which has been formed as an endless loop and which runs over the alignment rolls 14A,14B,14C,14D. The calendering belt 15 is loaded against the heatable hard roll 11 in order to form a nip N extended by means of two rolls 12A,12B provided with resilient coatings. Thus, the form of the nip N complies with the curve form of the heatable hard roll 11, and the length of the nip N depends on the diameters of the rolls, on the mutual distance between the rolls 12A,12B with resilient coatings, and on the way in which the calendering belt 15 has been guided to run through the nip N by means of the alignment rolls 14A,14B,14C,14D. By means of the calender in accordance with the invention shown in FIG. 2, the calendering process can be divided clearly into five successive stages, in which the relationship between the stages can be regulated or some stages can be omitted completely.

The first stage in the calendering process is a stage of preliminary contact, in which the material web W to be calendered, which will be called paper web in the following, is brought, from both sides, into contact with glazing, hot faces by passing the paper web into the gap between, in this case, in particular, a metal belt 15 and a heatable hard roll 11. The zone I of preliminary contact is formed so that the metal belt 15 is passed into contact with the heatable hard roll 11 even before the nip formed between the heatable hard roll 11 and the first resilient-faced roll 12A that supports the metal belt 15. The distance of preliminary contact, i.e. the length of the zone I of preliminary contact and, thus, the time of preliminary contact can be regulated by varying the angle of arrival of the metal belt 15 in relation to the heatable hard roll 11 by means of the first alignment roll 14A. The optimal length of the zone I of preliminary contact depends on the temperature gradient desired for the paper, which again depends on the paper grade, moisture, running speed, initial temperature of the paper, and on the temperatures of the faces that are in contact with the paper. The coefficient of heat transfer between the paper and the pressing face acts upon the conduction of heat from the roll 11 and from the metal belt 15 to the paper web W in the preliminary contact. Besides by the compression pressure between the paper and the pressing face, the heat transfer coefficient is also affected to a significant extent by the moisture of the paper, by the roughness and the purity of the pressing face, and by the porosity and smoothness of the paper.

After the temperature and the distribution of moisture in the paper W have been made suitable in the zone I of preliminary contact, the paper web W is passed into the press zone II, i.e. into the nip between the heatable hard roll 11 and the first roll 12 with resilient coating. In the press stage or, more correctly, in the press zone II the paper web W is pressed between hot, smooth faces, i.e. between the heatable hard roll 11 and the metal belt 15. The shape of the distribution of pressing in the press zone II is approximately similar to that in the nip in a supercalender or soft calender. The shape of the distribution of pressing can be affected by changing the coating material and/or the thickness of the roll coating 13A on the first roll 12A with resilient coating, by changing the roll diameters, and/or by regulating the loading between the rolls. In respect of the regulation of loading, it can be stated that, in respect of its construction and operation, the first roll 12A with resilient coating can be, for example, a roll adjustable in zones as shown in FIG. 2, in which the roll mantle 16A has been arranged to revolve around a stationary roll axle 17A, the roll mantle 16A being loaded towards the nip, in relation to the axle, by means of loading element 18A, in particular hydrostatic loading elements. By means of such a roll 12A adjustable in zones, the loading in the nip between said roll with resilient coating and the heatable hard roll 11 in the cross direction of the web can be made uniform, and, if desired, the load can be regulated as required. The metal belt 15, which complies with the curve form of the heatable hard roll 11, contributes to widening of the press zone and, thus, increases the time of effect.

In the calendering process, the press stage II is followed by a stage III of reversing of deformation, in which stage the paper web W continues to run supported between the heatable hard roll 11 and the metal belt 15. Thus, partial reversing of the deformation produced in the paper in the press stage II takes place under control against the smooth faces while the temperature of the paper is still above the glass transition temperature. A suitable pressing between the heatable hard roll 11 and the metal belt 15 is produced by regulating the tension of the metal belt 15 by means of the alignment belts 14A,14B,14C,14D. The function of the pressing between the metal belt 15 and the heatable hard roll 11 is not to compress the paper further, but expressly to support the reversing of the deformation produced in the paper so that the thickness can be restored but the face of the paper remains smooth. When the paper is supported during the reversing, raising of peak points in the paper is prevented, in which connection the valley points in the paper face tend to rise into contact with the pressing faces, and the smoothness of the paper is, thus, improved. During the stage of reversing of deformation the paper is constantly supported by the metal belt, but in the press zone II the paper tends to become wider. On the other hand, the friction between the smooth metal faces that support the paper and the paper face attempts to prevent widening of the web. This produces a press tension in the interior of the paper and a shear tension parallel to the face in the cross direction of the paper web by the effect of the friction. The press tension present in the interior of the paper attempts to raise the valley areas in the paper face, which improves the smoothness and the bulk of the paper. On the other hand, as was already stated earlier, a shear tension parallel to the paper face has an effect that increases the gloss of the paper.

As the next stage, i.e. after the stage of reversing of deformation, in the calendering process there is the finishing press stage IV. In this finishing press stage, the paper that was already once pressed and reversed is pressed again in a similar way as in the second stage, i.e. in the press stage, i.e. still between the metal belt 15 and the heatable hard roll 11 while a roll 12B with a resilient coating presses the metal belt 15 against the hard-faced heatable roll 11. The function of the finishing pressing is, by means of this second press pulse, to act in particular upon the portions of the paper that have remained uneven, for example, owing to a local variation in thickness. The effects of the finishing pressing extend deeper into the paper than the earlier stages, for in this stage the temperature gradient in the paper has had time to be equalized, and the temperature of the paper is throughout above the glass transition temperature. Out of this reason, the force required for deformation of the paper is lower than in the first press stage, and reduction of bulk takes place more readily. On the other hand, the deformations that are aimed at in the finishing pressing are relatively little, for the paper is already relatively smooth after the first three stages of glazing. Out of these reasons, the finishing press stage IV must be considerably more gentle than the first press stage II, i.e. it is necessary to employ a linear load and pressure considerably lower than in the first press stage in order that the bulk of the paper could be maintained. Regulation of the linear load is relatively simple if the second roll 12B provided with a resilient coating 13B is also, in accordance with the exemplifying embodiment shown in FIG. 2, a roll adjustable in zones corresponding to the first roll 12A with a resilient coating, in which roll the roll mantle 16B has been arranged to revolve similarly around the stationary roll axle 17B, the roll mantle 16B being loaded in relation to said roll axle towards the nip between said roll 12B provided with a resilient coating 13B and the heatable hard roll 11 by means of loading elements 18B.

The last stage, i.e. the fifth stage in the calendering process is the after-contact stage V, in which the paper W is kept, after the finishing pressing, between a metal belt 21 and the heatable hard roll 11. The function of the after-contact stage V is to support the reversing of the deformation produced in the finishing pressing and to allow the paper to remain in such a state that detrimental deformations are now present to an extent as little as possible. The length of the after-contact stage V can be regulated by regulating the position of the second alignment roll 14B. In view of the final result, it would be optimal if the paper could be cooled in a controlled way to a temperature below the glass transition temperature. After cooling, reversing of deformations occurring in the paper present in a glassy state remain little. Such cooling requires a second, similar metal belt calender which is placed directly after the glazing calender proper. The function of this second device is to conduct the heat away from the paper by means of an extended cooled nip so that the whole paper has solidified in a glassy state before it departs from the nip.

In a calender as shown in FIG. 2, the different calendering parameters can be regulated within quite wide ranges of variation. First, the temperatures of the faces that heat the paper web W can be regulated within a very wide range. The lower limit of the temperature is, in practice, the temperature of the factory hall unless the hard roll 11 and the metal belt 15 are factually cooled, which is also possible. It can be considered that cooling can be concerned mainly just in a case in which two metal belt calenders have been fitted one after the other, and a paper web that has already been glazed is cooled by means of the latter calender to a temperature below the glass transition temperature of the polymers contained in the paper in order to prevent roughening of the paper face as a result of reversing of deformation. In practice, however, constant cooling of a device of a size of a calender to a temperature considerably colder than the temperature of the environment becomes expensive and, as a rule, it is not even necessary, for the heat has time to be conducted out of the surface portions of the paper to a sufficient extent so that a temperature lower than the glass transition temperature is reached. The upper limit of the temperature in a metal belt calender depends on the paper grade to be glazed and on the particular application. The upper limit set by the equipment itself depends on the toleration of heat by the rolls 12A,12B with resilient coatings that support the metal belt 15. In view of the rolls with resilient coatings, it is possible to use higher temperatures than in a soft calender, for in both cases the roll coating is deformed once per revolution, but in a metal belt calender the cooling of the roll can be arranged more efficiently, because the roll in itself is not in direct contact with the paper and/or with the hot roll that constitutes a backup roll. The heating of the heatable hard roll 11 can be arranged by the means currently available, for example, by means of steam or fluid from inside or inductively from outside. The heating of the metal belt 15 is carried out best by means of induction. In order to avoid unequalsidedness, it is important that the faces that press each side of the paper are at the same temperature.

In the five-stage calendering process illustrated in FIG. 2, the paper web W is heated by means of contact heating. Heating in the calender as such is, however, not an end in itself, but the paper W to be calendered must be brought into such a state that copying of the calendering faces onto the paper can take place. If the paper is heated before the calender, for example, by means of infrared radiators to a temperature above the glass transition temperature, the stage of preliminary contact can be omitted completely, and the hard roll 11 and the metal belt 15 need not be heated separately. In such a case, the paper whose faces have been heated is passed directly into the press stage II, in which press stage the paper web is cooled to a temperature below the glass transition temperature at the same time as the face patterns of the pressing faces are copied onto the paper faces. The subsequent stages of the calendering process are carried out in the way described above.

Regulation of the moisture content in the paper web can be carried out by similar means as in the prior-art calenders. A suitable moisture gradient can be produced most easily by treating the paper face with steam right before the preliminary contact. When the extent of steam treatment is estimated, it is to be taken into account that during calendering almost no evaporation of moisture takes place, whereas it does take place in machine calenders and supercalenders after each nip, i.e. the paper must be dried before calendering to a dryness higher than the ultimate dryness aimed at, and the ultimate moisture content is reached by steam treating the paper faces right before the calendering.

In the five-stage calendering process as illustrated in FIG. 2, the pressure treatment to which the paper is subjected consists of the sums of the distributions of pressure in the different stages. The distributions in the different stages can be regulated at least partly independently from one another. In the stage of preliminary contact, the pressing can be regulated by varying the tension of the metal belt 15. Besides upon the contact between the paper and the pressing face, the press force also acts upon the heat transfer coefficient. This coefficient is also affected by the moisture of the paper face. In the stage of preliminary contact, the press force ought to be as high as possible. In such a case, the limiting factor is the strength of the metal belt 15, i.e. how far the metal belt 15 can be tightened without damage to the belt in operation as a result of fatigue. In the first press stage II, the distribution of pressing is approximately similar to that in the nip in a supercalender or soft calender. The rigidity of the metal belt 15, however, widens the form of the distribution of pressing and thereby increases the time of effect of the pressing. In the zone III of reversing of deformation placed between the press stages II and IV, the pressing again results from the tension of the metal belt 15. Also at this stage, the pressure may be as high as is permitted by the strength of the belt in order that the faces of the paper were supported as tightly as possible during the pressing and in order that undesirable reversing of deformations and folding of paper could be prevented.

The pressing produced by means of the tension of the metal belt 15 is, in any case, considerably little in comparison with pressing produced by means of rolls. If necessary, the pressing could be increased by producing an electromagnetic attractive force between the metal belt and the heatable hard roll 11 or by supporting the metal belt 15 from the rear side by means of a particular glide shoe. However, it is a drawback of each of these solutions that they make the equipment as a whole more complicated. The shape of the distribution of pressure in the finishing press stage IV corresponds to the first press stage II, but in the finishing pressing the linear load must be regulated to such a level that the bulk of the paper is not deteriorated. In the after-contact stage V, the press distribution is similar to that in the stage I of preliminary contact, and the length of after-contact and so also the time of after contact can be regulated as required by varying the angle of departure of the metal belt 15.

With reference to the description given above, by means of the invention, a calendering method is provided which can be applied to calendering of a number of paper grades because of its wide-range adjustability. In view of the calendering process, it can be stated further that the calendering belt can be heated, in particular in the case of a metal belt. In the case of other materials and also in the case of a metal material, the calendering belt can be, for example, cooled, moistened, etc., as required. In the calender, one belt can be heated and the belt placed at the opposite side of the nip can be cooled, in which case a phenomenon is produced in which the moisture present in the material web to be calendered can be made to be transferred in the calendering nip from the heated side to the cooled side, whereby the face of the material to be calendered that is placed at the side of the heated belt can be made very good. Such a solution is very well suitable for one-sided calendering, in particular for calendering of board. Earlier, it was already stated that one essential feature of the belt is its hardness in comparison with the roll coating. This provides the highly significant advantage that the threading is free from problems and easy, for the end of the web can be passed through the calender as of full width.

The calender and the calendering method described above, as illustrated in FIG. 2, can be improved further and developed, for example, in compliance with the web for whose calendering the invention is meant in particular and with the calendering result that is desired to be produced. Attempts have also be made to illustrate these particular features by means of FIG. 2. At the inlet side of the calendering nip N, if necessary, it is possible to provide, for example, steam treatment, heating and/or cooling devices. Further, the web W can be pre-moistened before calendering if this is considered necessary. When steam is fed into the gap between the web W and the member that calenders the web, such as the hot hard roll 11 and/or the calendering belt 15, an air-free space is obtained between the web W and the calendering member 11 and/or 15. Even in this way alone, the calendering result can be improved, because in such a case, by evacuating the air, the transfer of heat can be made considerably more efficient. The steam supply means are denoted in FIG. 2 schematically with the reference numeral 20 at the side of the hot hard roll 11 and with the reference numeral 21 at the side of the calendering belt 15.

In addition to the supply of steam, or as a solution alternative to the supply of steam, the web W can be pre-moistened at the side of the hot roll 11, which improves the transfer of heat between the hot roll 11 and the web W further. For moistening, it is possible to use separate moistening means 22, or for moistening it is also possible to think of the steam supply means 20 described above being used at the side of the hot roll 11. The web W can also be pre-heated at least from the side of the hot roll 11 before the web enters into the nip N. For pre-heating, it is possible to think of the steam supply means 20 to be used, but instead of the separate pre-moistening means 22 described above, it is also possible to use separate pre-heating means 22. Depending on the desired calendering result and on the grade of the web W to be calendered, the pre-heating or pre-cooling can also be provided at the opposite side of the web W, i.e. at the side of the calendering belt 15. These means intended for pre-heating or pre-cooling are denoted with the reference numeral 23 in FIG. 2.

In one-sided calendering of the web W, in particular in calendering of board, it is favourable that the web W is cooled from the side opposite to the hot roll 11 by cooling the calendering belt 15 by means of cooling means 23. In such a case, calendering of the web W forces the moisture present in the web to the side of the cool calendering belt 15, in which case the face of the web W placed at the side of the hot roll becomes of very high quality. When the temperature of the calendering belt 15 is regulated, the curl of the web W can also be brought under control. When this is further connected with steam treatment in the nip N by means of steam treatment means 20,21 and with pre-moistening 22 of the web from the side of the hot roll 11, a board of very high quality is obtained which has been calendered one-sidedly.

Differing from the running situation shown in FIG. 2, the calendering, in particular the calendering of board, can also be carried out so that the calender is run so that the rolls 12A,12B provided with resilient coatings 13A,13B are apart from contact with the calendering belt 15. In such a case, by means of the tension of the calendering belt 15, a load sufficient for calendering is produced in the extended calendering nip N. In particular, the calendering of a board web can be carried out by means of such a solution. In such a case, the nip formation rolls can also be omitted in the calendering device, and it is possible to utilize exclusively the pressure produced by the belt tension against the backup roll.

Above, the invention has been described just by way of example with reference to the figures in the accompanying drawing. The invention is, however, not confined to the exemplifying embodiments shown in the figures alone, but different embodiments of the invention may show variation within the scope of the inventive idea defined in the accompanying patent claims.

What is claimed is:

1. A calendering method for calendering a web comprising the steps of:

passing a web thorough a calender having a calender nip defined by a heatable hard roll and an endless, flexible and substantially non-compressible belt passed over said hard roll;

heating the hard roll in order to plasticize a surface layer of said web;

bringing said web into preliminary contact with the heatable hard roll before the calendering of the web;

applying a press treatment to the web in a press stage after the web makes preliminary contact with said heatable hard roll wherein in said press treatment said web is calendered between the heatable hard roll and the calendering belt by means of a first roll provided with a resilient coating to produce a deformation;

partially reversing said deformation produced in said press treatment and maintaining control over said reversing by maintaining support of the web between the heatable hard roll and the calendering belt;

pressing the web in a finishing stage to produce a new deformation in the web by pressing the web between the heatable hard roll and the calendering belt by means of a second roll provided with a resilient coating.

2. A calendering method for calendering a web as claimed in claim 1, further comprising:

supporting the web after the finishing stage by means of the calendering belt over a certain distance against the heatable hard roll before the web is passed apart from between the heatable hard roll and the calendering belt.

3. A calendering method for calendering a web as claimed in claim 1, wherein a substantially lower pressure and linear load are applied in said finishing stage relative to a pressure and linear load applied in said press stage.

4. A calendering method for calendering a web as claimed in claim 1, wherein during said reversing of said deformation said web is supported so that a thickness of said web can be restored at least partially so that a calendered face of said web remains smooth.

5. A calendering method for calendering a web as claimed in claim 1, wherein a length of said preliminary contact is regulated in compliance with a desired temperature gradient by regulating an angle of arrival at which the calendering belt enters into contact with the heatable hard roll.

6. A calendering method for calendering a web as claimed in claim 1, wherein a length of an after-contact zone is regulated.

7. A calendering method for calendering a web as claimed in claim 1, further comprising:

steam treating said web before said web makes preliminary contact with said heatable hard roll.

8. A calendering method for calendering a web as claimed in claim 1 further comprising:

moistening said web before said web makes preliminary contact with said heatable hard roll.

9. A calendering method for calendering a web as claimed in claim 1, further comprising:

cooling the web from the side of the calendering belt at the latest before the web enters into said press stage.

10. A calender comprising:

a heatable hard roll;

an endless, flexible and substantially non-compressible calendering belt passed over said roll, said heatable hard roll and said belt defining a calendering nip;

wherein said heatable hard roll is adapted to make preliminary contact with a web to be calendered prior to said web being calendered between said heatable hard roll and said calendering belt;

at least two calender rolls each provided with a resilient coating, said at least two calendering rolls being structured and arranged to press the calendering belt against the heatable hard roll, and said at least two calender rolls being structured and arranged to define a press zone proper, a zone of reversing after the press zone, a zone in which the web to be calendered is supported between the calender belt and the heatable roll and a finishing zone arranged after the reversing zone.

11. A calender as claimed in claim 10, wherein said calendering belt is made from a metal.

12. A calender as claimed in claim 10, wherein said calendering belt is a fiber-reinforced hard polymer belt.

13. A calender as claimed in claim 10, wherein said calendering belt is structured and arranged to be guided after the finishing zone stage over a certain distance against the heatable roll before the web is passed apart from between the heatable roll and the calendering belt so as to form an after-contact zone for the web, in which zone the web is supported between the heatable roll and the calendering belt.

14. A calender as claimed in claim 13, wherein a length of said after-contact zone is adjustable.

15. A calender as claimed in claim 10, wherein said at least two calender rolls are adjustable to thereby enable an adjustment of a pressure applied by said at least two calender rolls against said heatable roll.

16. A calender as claimed in claim 10, wherein in said finishing zone a linear load is applied which is substantially lower than a linear load applied in said press zone.

17. A calender as claimed in claim 10, wherein each of said at least two calendering rolls are adjustable.

18. A calender as claimed in claim 10, wherein in said reversing zone said web is supported between said calendering belt and said heatable roll so that a thickness of the web can be at least partially restored so that a calendered face of said web remains smooth.

19. A calender as claimed in claim 10, wherein said web makes preliminary contact with said heatable roll over a preliminary contact zone, a length of said preliminary contact zone being adjustable in compliance with a desired temperature gradient by regulating an angle of arrival at which the calendering belt enters into contact with the heatable hard roll.

20. A calender as claimed in claim 10, further comprising:

means for steam treating the web before the preliminary contact of the web with the heatable roll.

21. A calender as claimed in claim 10, further comprising:

means for moistening the web before the preliminary contact of the web with the heatable roll.

22. A calender as claimed in claim 10, further comprising:

means for cooling the calendering belt at the latest before the web enters into the press zone proper.

* * * * *